US011744339B2

(12) United States Patent
Kelsch et al.

(10) Patent No.: US 11,744,339 B2
(45) **Date of Patent: *Sep. 5, 2023**

(54) RETRACTABLE JEWELRY TRAVEL SCROLL

(71) Applicants: Carrie K. Kelsch, Herriman, UT (US); Ryan J. Humphreys, Herriman, UT (US); David K. Kelsch, Herriman, UT (US); Jean B. Kelsch, Herriman, UT (US)

(72) Inventors: Carrie K. Kelsch, Herriman, UT (US); Ryan J. Humphreys, Herriman, UT (US); David K. Kelsch, Herriman, UT (US); Jean B. Kelsch, Herriman, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/478,330

(22) Filed: Sep. 17, 2021

(65) Prior Publication Data

US 2022/0000232 A1 Jan. 6, 2022

Related U.S. Application Data

(63) Continuation-in-part of application No. 16/987,392, filed on Aug. 6, 2020, now Pat. No. 11,399,607.

(60) Provisional application No. 62/883,226, filed on Aug. 6, 2019.

(51) Int. Cl.

| | |
|---|---|
| ***A45C 11/04*** | (2006.01) |
| ***A45C 11/16*** | (2006.01) |
| ***A45C 13/08*** | (2006.01) |
| ***A45C 7/00*** | (2006.01) |
| ***A45C 13/04*** | (2006.01) |
| ***A45C 13/30*** | (2006.01) |

(52) U.S. Cl.

CPC ..... *A45C 11/16* (2013.01); *A45C 7/0077* (2013.01); *A45C 13/04* (2013.01); *A45C 13/08* (2013.01); *A45C 13/30* (2013.01)

(58) Field of Classification Search

CPC ..... A45C 7/0077; A45C 11/16; A45C 13/04; A45C 13/08; A45C 13/30; A47F 7/02

USPC ..... 206/6.1, 457, 493, 495, 806; 211/85.2, 211/113

See application file for complete search history.

(56) References Cited

U.S. PATENT DOCUMENTS

| | | | | |
|---|---|---|---|---|
| 2,055,511 | A * | 9/1936 | Twiss | E06B 9/62 160/310 |
| 4,118,066 | A | 10/1978 | Ricke | |
| 4,223,783 | A * | 9/1980 | Marshall | B65D 85/30 229/92 |
| 4,413,665 | A | 11/1983 | Corcoran | |
| 4,487,244 | A | 12/1984 | Olson | |
| 4,514,725 | A | 4/1985 | Bristley | |
| 4,790,592 | A | 12/1988 | Busso et al. | |
| 4,848,562 | A * | 7/1989 | Liu | A45C 13/02 150/108 |

(Continued)

OTHER PUBLICATIONS

Office Action received for U.S. Appl. No. 16/987,392, dated Feb. 17, 2022, 6 pages.

*Primary Examiner* — Luan K Bui

(74) *Attorney, Agent, or Firm* — Workman Nydegger

(57) ABSTRACT

A retractable jewelry travel scroll includes a frame, a spring-loaded tube rotatably suspended between the frame, and a sheet attached along one end to the tube. The sheet has one or more jewelry retention members connected thereto and one or more pockets thereon.

13 Claims, 8 Drawing Sheets

(56) References Cited

U.S. PATENT DOCUMENTS

| | | | | |
|---|---|---|---|---|
| 5,121,833 | A * | 6/1992 | Lindsay | A45C 7/0095 D6/513 |
| 5,209,344 | A | 5/1993 | Smith | |
| 5,427,230 | A | 6/1995 | Mattox | |
| 6,733,204 | B1 * | 5/2004 | Paniccia | E01F 7/00 404/9 |
| 7,389,868 | B2 | 6/2008 | Lewand et al. | |
| 7,594,695 | B2 | 9/2009 | Noonan | |
| 8,915,354 | B1 * | 12/2014 | Smith | A45C 11/26 206/495 |
| 11,399,607 | B2 | 8/2022 | Kelsch et al. | |
| 2005/0257867 | A1 * | 11/2005 | Vazin | A45C 13/08 150/110 |
| 2014/0374036 | A1 | 12/2014 | Chen | |
| 2015/0047792 | A1 | 2/2015 | Lukosiunas et al. | |
| 2019/0010756 | A1 | 1/2019 | Lin | |
| 2021/0127807 | A1 | 5/2021 | Kelsch et al. | |

* cited by examiner

RETRACTABLE JEWELRY TRAVEL SCROLL

CROSS-REFERENCE TO RELATED APPLICATIONS

The present application is a continuation in part of U.S. application Ser. No. 16/987,392, filed Aug. 6, 2020, and entitled Retractable Necklace Travel Scroll, which claims priority to and the benefit of U.S. Provisional Patent Application No. 62/883,226, filed Aug. 6, 2019, entitled Retractable Necklace Travel Scroll, the entire content of each of which is incorporated herein by this reference.

BACKGROUND

1. Technical Field

The present disclosure relates generally to receptacles for jewelry, such as necklaces, and more particularly, to receptacles which can be rolled into a scroll to prevent the contained items from becoming tangled and entangled.

2. Relevant Technology

Jewelry, such as necklaces and bracelets, are difficult to store and transport because even the chain of a single item can become tangled. Multiple necklaces and/or bracelets are even more problematic, as not only the chain of each necklace and/or bracelet can become tangled, but the chains of multiple necklaces and/or bracelets can become intertangled. Various devices have been created in an effort to facilitate storage and/or transportation of jewelry while preventing the jewelry from becoming tangled. In spite of such devices, there is still a need for a device which more conveniently stores jewelry items and enables them to be transported while traveling without the items becoming tangled.

BRIEF SUMMARY

The present disclosure provides a jewelry travel scroll, which may also be described as a display, storage, and/or carrying case for jewelry items, such as necklaces and bracelets. Such items are likely to become easily tangled and entangled with other similar items if they are not maintained under conditions that prevent single necklaces or bracelets from tangling and knotting and kept apart from one another so that they do not become entangled.

According to one example embodiment, the jewelry travel scroll includes an inverted-V-shaped frame, a spring-loaded tube rotatably suspended between the frame, a rectangular cloth sheet attached along one edge to the tube, with an opposite edge wrapped around a weighted rod to form a pocket on a front surface of the cloth sheet. A plurality of equally-spaced jewelry hanging hooks are secured to an upper portion of the cloth sheet. One end of a necklaces is attached to a single hanging hook. The opposite end of the necklace is tucked into the pocket. Although the current embodiment of the invention has eleven such hanging hooks, that number can be augmented or reduced as desired. Much like a roll-up blind, by tugging on the weighted rod at the bottom of the pocket, the roll-up mechanism is released and spring loading causes the tube to wind up the cloth sheet until the weighted rod contacts opposite ends of the inverted-V-shaped frame. Multiple necklaces can be transported in this rolled-up configuration with little or no concern that the necklaces will be tangled or entangled with one another. A chain is secured to the center of the frame and a closet clothes rod hook is attached to the free end of the chain. This enables the necklace travel scroll to be hung on a closet clothes rod in either a retracted (rolled-up) configuration or an extended (unrolled) configuration. By pulling down on the weighted rod, the cloth sheet can be extended to display the stored necklaces. The tube automatically locks at the distance it is unrolled. Pulling down again on the weighted rod will cause the cloth to once again roll up around the tube.

According to another example embodiment, a retractable jewelry scroll includes a frame, a spring-loaded tube rotatably mounted to the frame, a sheet having a first end and a second end, the first end being attached to the tube, the sheet having one or more pockets disposed thereon or therein, and one or more jewelry retention members attached to the sheet and spaced apart from the one or more pockets.

In another embodiment, a retractable jewelry scroll includes a decorative body. A frame is mounted to an interior of the decorative body such that the decorative body surrounds a substantial portion of the frame. A spring-loaded tube is rotatably mounted to the frame. A sheet has a first end and a second end, the first end being attached to the tube. The sheet has one or more pockets disposed thereon or therein. One or more jewelry retention members are attached to the sheet and spaced apart from the one or more pockets.

In yet another embodiment, a retractable jewelry scroll includes a frame. A spring-loaded tube is rotatably mounted to the frame. A sheet has a first end and a second end, the first end being attached to the tube. The sheet has one or more pockets disposed thereon or therein. One or more jewelry retention members are attached to the sheet and spaced apart from the one or more pockets. A sleeve has an opening therein and is configured to have the frame selectively inserted into or removed therefrom through the opening.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the disclosed embodiments can be obtained, a more particular description of the disclosed embodiments briefly described above will be rendered by reference to specific embodiments thereof which are illustrated in the appended drawings. For better understanding, the like elements have been designated by like reference numbers throughout the various accompanying figures. Understanding that these drawings depict only typical embodiments and are not therefore to be considered to be limiting of the scope of the present disclosure or claims, embodiments will be described and explained with additional specificity and detail through the use of the accompanying drawings in which:

DETAILED DESCRIPTION

The jewelry travel scroll will now be described in detail, with reference to the attached drawing figures.

Figure 1:
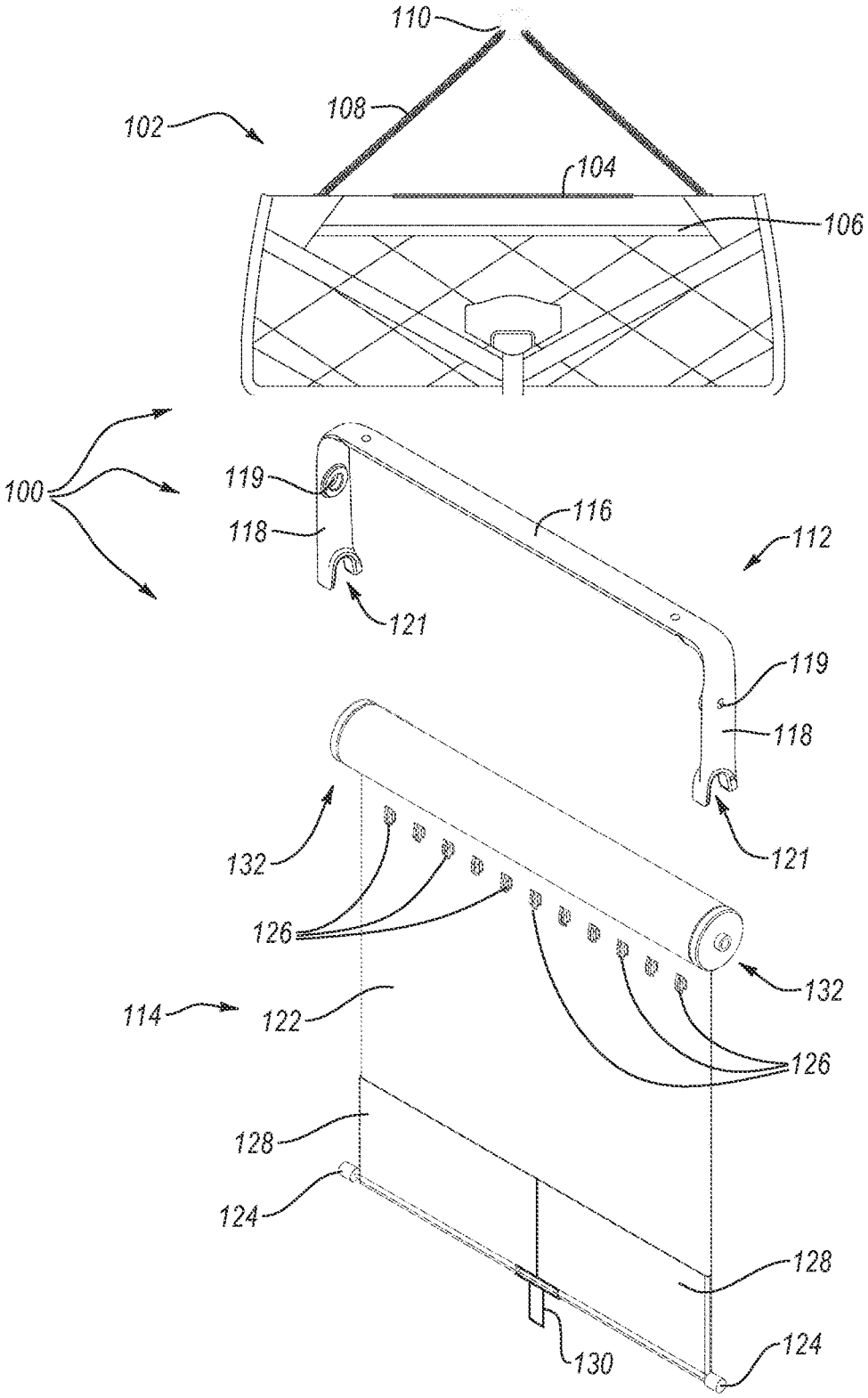
FIG. 1 is a partially exploded perspective view of a retractable jewelry travel scroll according to an example embodiment.

FIG. 1 illustrates an exploded perspective view of a jewelry travel scroll 100 according to one example embodiment. The jewelry travel scroll 100 may also be referred to as a storage and carrying case for jewelry items, such as necklaces, bracelets, etc. Such jewelry items are prone to become easily tangled and entangled with other similar items if they are not maintained under conditions that prevent single jewelry items from tangling and knotting and kept apart from one another so that they do not become entangled.

As can be seen in FIG. 1, the jewelry travel scroll 100 includes a cover 102. The cover 102 can take the form of a decorative cover that provides the jewelry travel scroll 100 with an appealing aesthetic. In the illustrate embodiment, the cover 102 includes a handle 104 that can be used to hold or carry the jewelry travel scroll 100. The cover 102 also includes a pocket with an opening 106. The pocket can be used to store small jewelry (e.g., earrings, rings, etc.) or other items therein. The opening 106 may include a closure mechanism (e.g., zipper, snaps, buttons, hook and loop fasteners, etc.) that allow for the opening 106 to be selective opened and closed to allow for the items stored therein to be inserted or removed when opened and retained therein when closed.

The cover 102 can also include a chain or strap 108 that can be used to hold or carry the jewelry travel scroll 100. The chain or strap 108 may have one or both ends thereof connected to a main body portion of the cover 102. In some embodiments, a hook or clip 110 can be connected to the chain or strap 108. The hook or clip 110 can be used to hang or suspend the jewelry travel scroll 100 from another object (e.g., a clothes rod, door handle, etc.) in either a retracted (rolled-up) configuration or an extended (unrolled) configuration.

Figure 2:
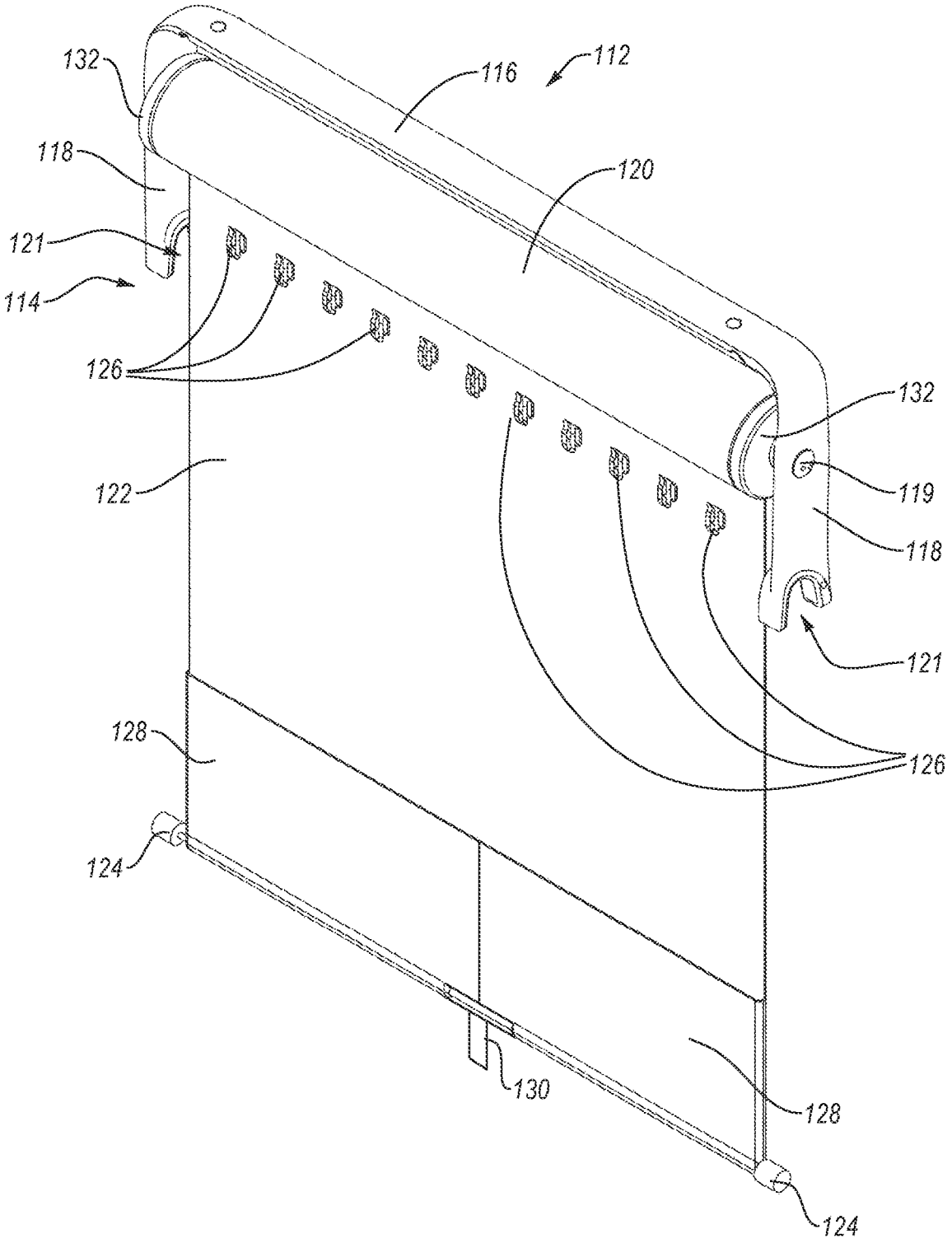
FIG. 2 illustrates a frame and a scroll of the retractable jewelry travel scroll of FIG. 1 mounted together.

As also shown in FIG. 1, the jewelry travel scroll 100 also includes a frame 112 with a scroll 114 that is mountable to the frame 112. FIG. 2 illustrates the scroll 114 mounted to the frame 112. As shown in FIGS. 1 and 2, the frame 112 includes a cross beam or cross support 116 and a leg 118 extending from opposing ends of the cross support 116. The cross support 116 is configured to be connected to the cover 102 (e.g., with rivets, screws, adhesive, fabric, or other fastener or mechanism). For instance, the cross support 116 can be connected to an interior surface of the cover 102 below the handle 104 and/or chain or strap 108. In some embodiments, the frame 112 may be considered to have a generally U, V, or C shape.

Each of the legs 118 includes a securing element 119 that can be used to secure the frame 112 and the scroll 114 together. In some embodiments, the securing elements may include an opening through each leg 118 that is configured to receive a fastener (e.g., bolt, screw, etc.) therethrough that can secure the frame 112 to the scroll 114. In other embodiments, the securing elements 119 may include a slot, recess, or cavity formed in each leg 118. The lower ends of the legs 118 also include slots, channels, or recess 121, which will be described in greater detail below.

The scroll 114 includes a spring-loaded tube 120 rotatably suspended or mounted between the legs 118 of the frame 112. The scroll 114 also include a sheet 122. A first edge or end of the sheet 122 is attached or connected to the tube 120. The sheet 122 also include an opposite second edge or end connected to a rod 124. In some embodiments, the sheet 122 has a generally rectangular shape. Furthermore, in some embodiments, the sheet 122 may be formed of or have attached thereto a material that is soft and/or non-abrasive. For instance, the sheet 122 may be formed of a velvet or other cloth material. The sheet material may be selected so that the sheet 122 may at least partially conform to the contours of jewelry items stored in the jewelry travel scroll 100. The sheet material may also or alternatively be selected to limit or prevent movement of the jewelry items and/or damage (e.g., scratched, etc.) to the jewelry items.

The sheet 122 may be attached to the rod 124 along all or a portion of the width of the sheet 122 and/or the rod 124. In some embodiments, the sheet 122 is wrapped around the rod 124 and secured to itself to secure the sheet 122 and the rod 124 together. In other embodiments, the rod 124 may have a channel that extends partial or entirely along its length. A portion of the sheet 122 may be inserted into and retained in the channel to secure the sheet 122 and the rod 124 together. In still other embodiments, the sheet 122 and the rod 124 may be secured together with clips, adhesives, or the like. The rod 124 may be configured to hold the sheet 122 is a generally flat or spread-out configuration. Additionally, as will be described in greater detail below, the rod 124 may facilitate the unrolling and/or rolling up of the sheet 122 around the tube 120.

The sheet 122 also includes a plurality of jewelry retention members 126 disposed on a front surface thereof. The jewelry retention members 126 are disposed on the sheet 122 on an upper portion thereof and/or adjacent to the tube 120. The jewelry retention members 126 may take the form of hooks, clips, rings, loops, or other structure to which a jewelry item may be secured or from which a jewelry item may be attached. The number of jewelry retention members 126 may be varied from one embodiment to another. Furthermore, while the jewelry retention members 126 are illustrated as being aligned with one another (e.g., at a common distance from the tube 120 and/or the rod 124), this is merely exemplary. In other embodiments, jewelry retention members 126 may have a staggered arrangement (e.g., be disposed at different distances from the tube 120 and/or the rod 124). Having the jewelry retention members 126 at different distances from the tube 120 and/or the rod 124 may accommodate jewelry items of different lengths.

The sheet 122 may also include one or more pockets 128 on a front surface thereof. In the illustrated embodiment, the sheet 122 includes two pockets 128 disposed at a lower end thereof (e.g., adjacent to the rod 124). In some embodiments, the number of pockets 128 may correspond to the number of jewelry retention members 126. In other embodiments, the number of pockets 128 may be higher or lower than the number of jewelry retention members 126. In any event, each pocket includes an opening therein. Each of the openings to the pocket(s) 128 open towards the tube 120.

In use, one end of each necklace or other jewelry item is attached to a single jewelry retention member 126 (i.e., one necklace or other jewelry item per jewelry retention member 126). The opposite end of each necklace or other jewelry item is tucked into a pocket 128.

The opposing or back of the sheet 122 may also include one or more jewelry retention members 126 and/or one or more pockets 128. In such embodiments, jewelry items may be mounted on the front of the sheet 122 and/or the back of the sheet 122.

The scroll 114 may also include a pull 130. In the illustrated embodiment, the pull 130 is disposed at the lower end of the sheet 122 and extends below the rod 124. The pull may be formed of the same material as the sheet 122 or another material. In other embodiments, the sheet 122 and/or the pocket(s) 128 may include an opening therethrough and above the rod 124. The opening and the rod 124 may cooperate to form a pull.

The sheet 122 can be selectively rolled up or wound around the tube 120. For instance, by pulling or tugging on the pull 130, the rod 124, and/or the sheet 122, roll-up mechanisms 132 at each end of the tube 120 are released and a spring loading of the tube 120 causes the tube to wind up the sheet 122 until the opposing ends of the rod 124 contact the slots, channels, or recesses 121 in the leg 118 of the frame 112. In some embodiments, the slots, channels, or recesses 121 may be sized and/or shaped to retain the ends of the rod 124 therein. Multiple necklaces or other jewelry items can be transported in this rolled-up configuration with little or no concern that the necklaces or other jewelry items will be tangled or entangled with one another.

By pulling down on the pull 130 and/or the rod 124, the sheet 122 can be extended (e.g., unwound from the tube 120) to display the stored necklaces. The tube 102 can automatically lock at the distance to which the sheet 122 is unrolled. Pulling down again on the pull 130, the rod 124, and/or the sheet 122 will cause the sheet 122 to once again roll up around the tube 120.

Figure 3:
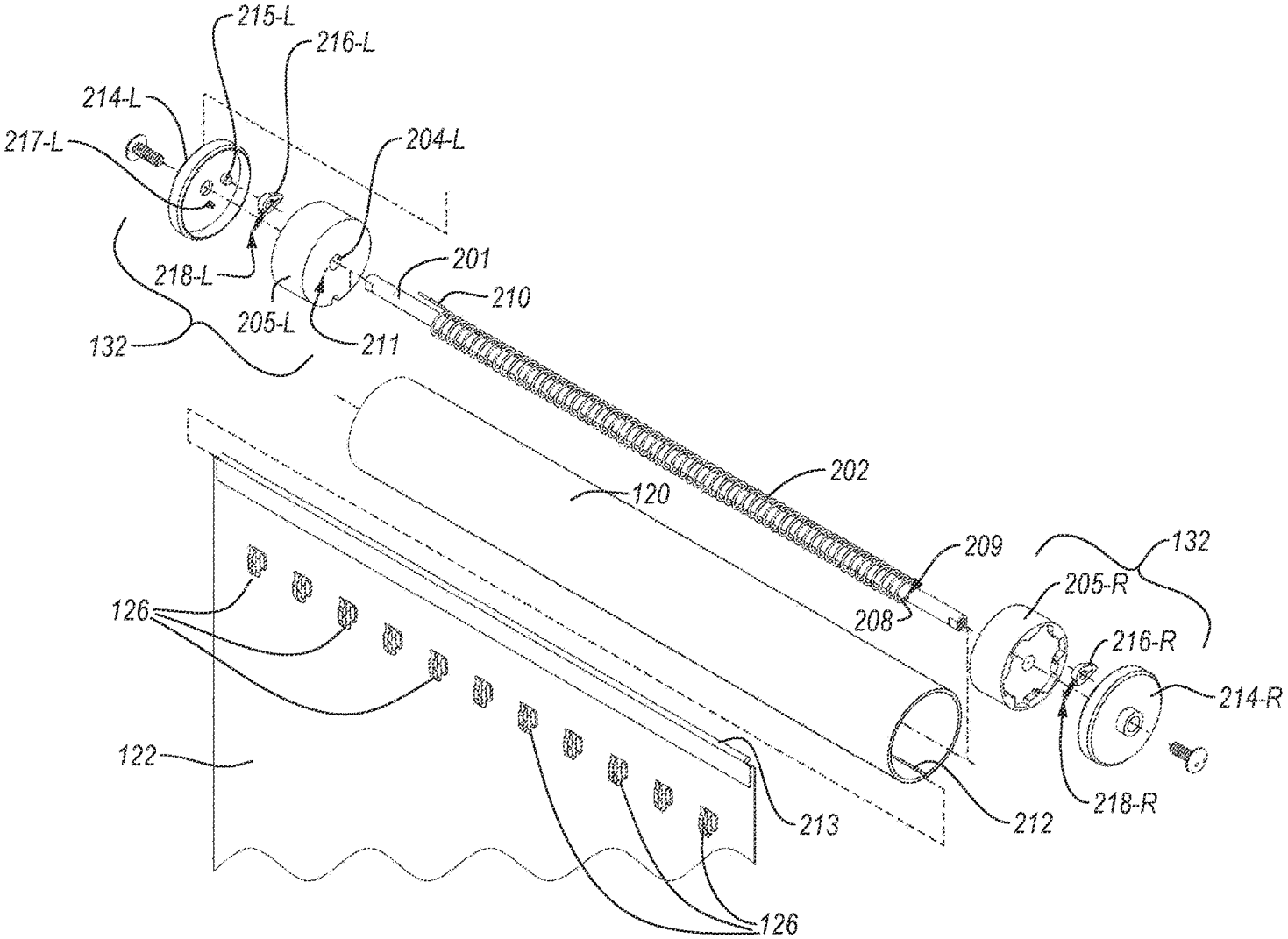
FIG. 3 is an exploded perspective view of a portion of the scroll of the retractable jewelry travel scroll of FIG. 1.
Figure 4:
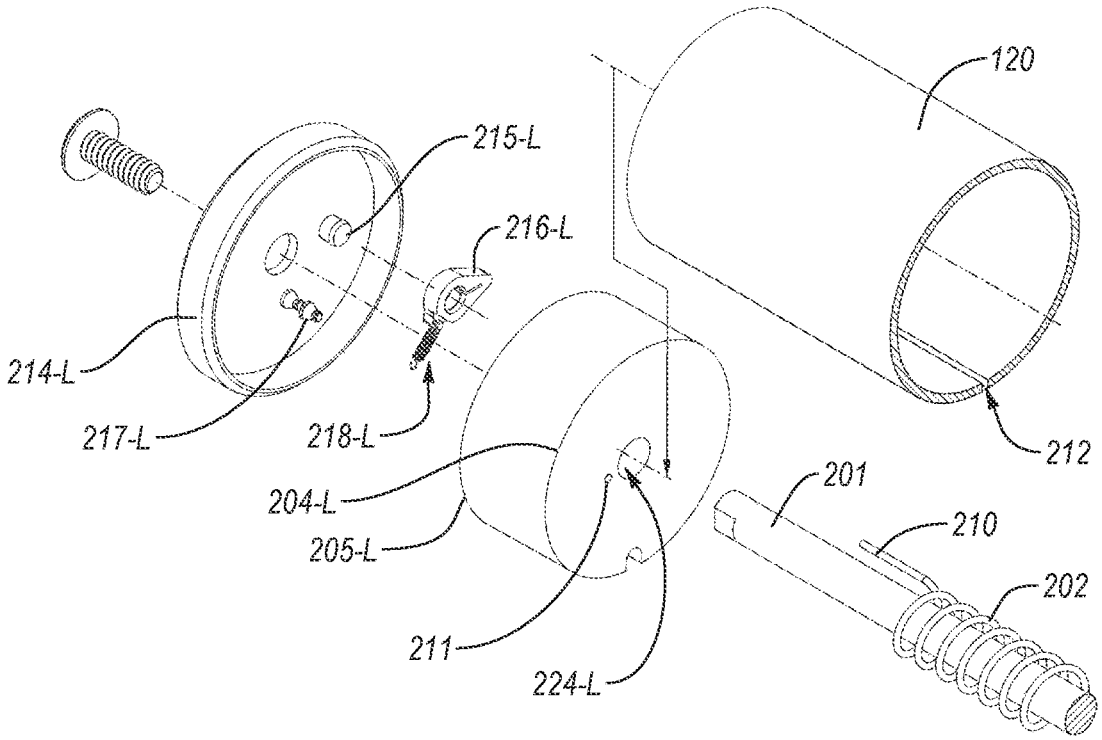
FIG. 4 is an exploded view of the left side of the scroll of FIG. 3.
Figure 5:
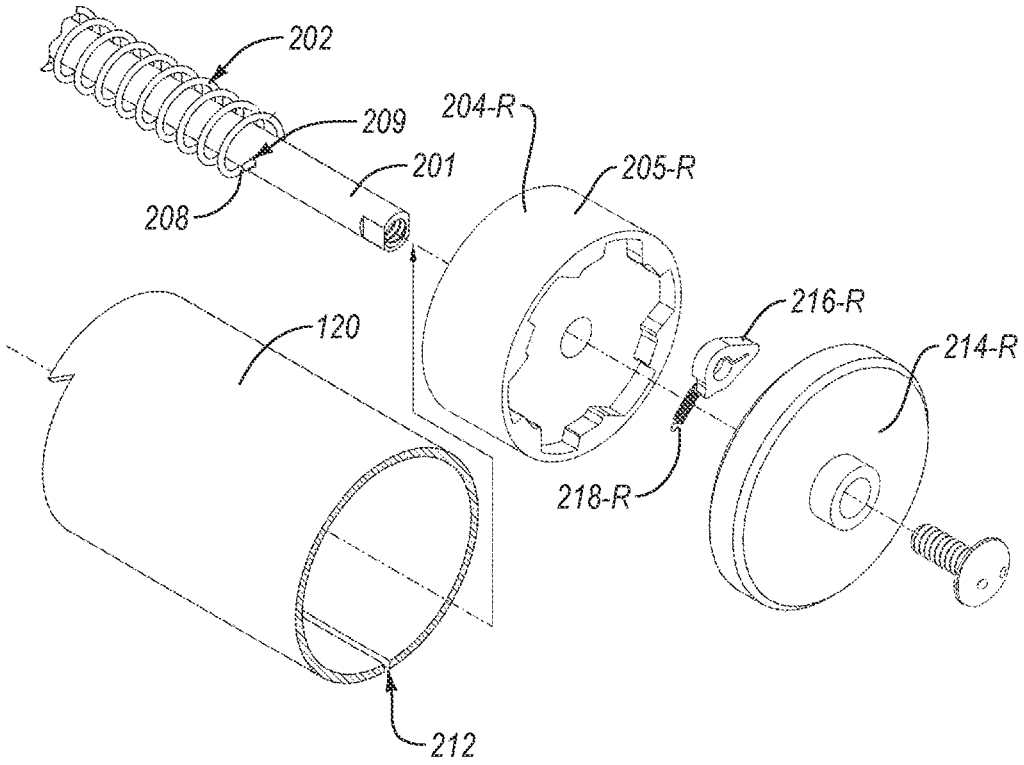
FIG. 5 is an exploded view of the right side of the scroll of FIG. 3.

Referring now to FIGS. 3, 4, and 5, exemplary spring-loaded mechanisms are illustrated that can be used to roll up the sheet 122 around the tube 120. It will be appreciated, however, that the illustrated mechanisms are merely exemplary and other spring-loaded mechanisms may be used.

In the illustrated embodiment, the scroll 114 is shown in an exploded view. The tube 120 slips over a support rod 201, which is inserted through a coil torsion spring 202. A left end of the tube 120 is affixed to a cylindrical extension 204-L on a left cogwheel 205-L. A right end 208 of coil torsion spring 202 is anchored within a transverse aperture 209 in the support rod 201, while a left end 210 of the coil torsion spring 202 is anchored within an aperture 211 in the cylindrical extension 204-L of the left cogwheel 205L.

Before the right end of the tube 120 is affixed to a cylindrical extension 204-R on a right cogwheel 205-R, the sheet 122 is inserted within the slot 212 in the tube 120 with the bead 213 at the top of sheet 122 being positioned inside the tube 120. The left cogwheel 205-L and the right cogwheel 205-R are mirror images of one another, with the exception that there need be no aperture equivalent to aperture 211 in the cylindrical extension 204-R. The left cogwheel 205-L rotates about the left end of support rod 201, while the right cogwheel 205-R rotates about the right end of support rod 201.

Still referring to FIGS. 3, 4, and 5, a left end cap 214-L provides a pivot pin 215-L for a left pawl 216-L and an anchoring pin 217-L for left pawl spring 218-L. Likewise, a right end cap 214-R provides a pivot pin 215-R (not shown) for a right pawl 216-R and an anchoring pin 217-R (not shown) for right pawl spring 218-R. The right end cap 214-R and the left end cap 214-L are also mirror images of one another. The right leg 218 of the frame 112 can be connected to the right end cap 214-R in a manner that prevents the latter from rotating about the support rod 201. Likewise, the left leg 218 of the frame 112 can be connected to the right end cap 214-R in a manner that prevents the latter from rotating about the support rod 201.

Still referring to FIGS. 2, 3 and 4, in order to provide spring tension on the tube 120 so that it will roll up the sheet 122, the rod 124 is removed from the bottom of the sheet 122, and the sheet 122 is wrapped around the tube 120. In order to apply some pretension to the coil torsion spring 202, the bottom edge of the sheet 122 is pulled in a downward direction, thereby partially unrolling it. The free, unrolled portion is then wrapped around the tube 120, maintaining the preload torsion on the coil torsion spring 202. The rod 124 is then reinstalled in the bottom edge of the sheet 122. The extended ends of the rod 124 engage the lower ends of the legs 118 to prevent the tube 120 from rotating and relieving the preload torsion on the coil torsion spring 202.

Figure 6:
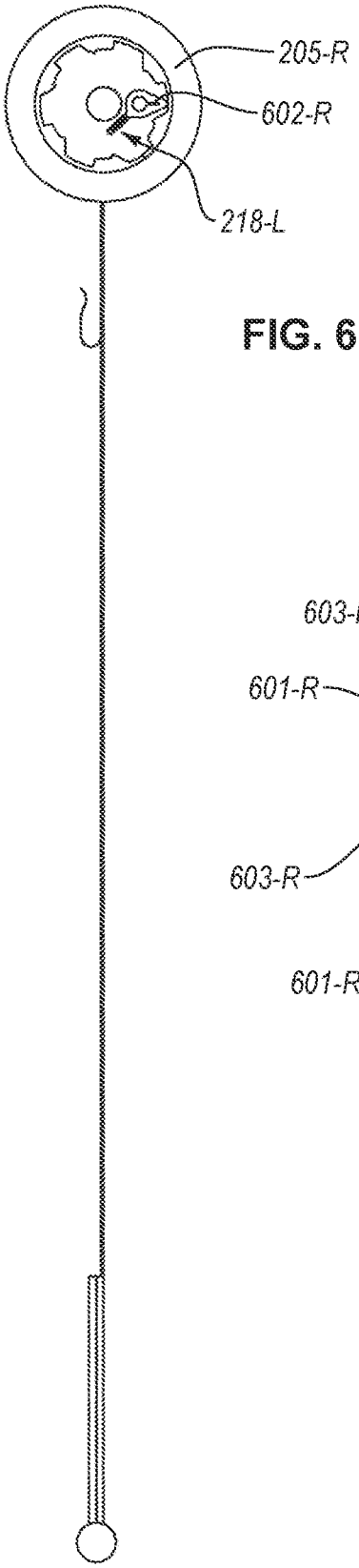
FIG. 6 is a right side elevational view of the scroll of FIG. 3, with a right end cap removed.
Figure 7:
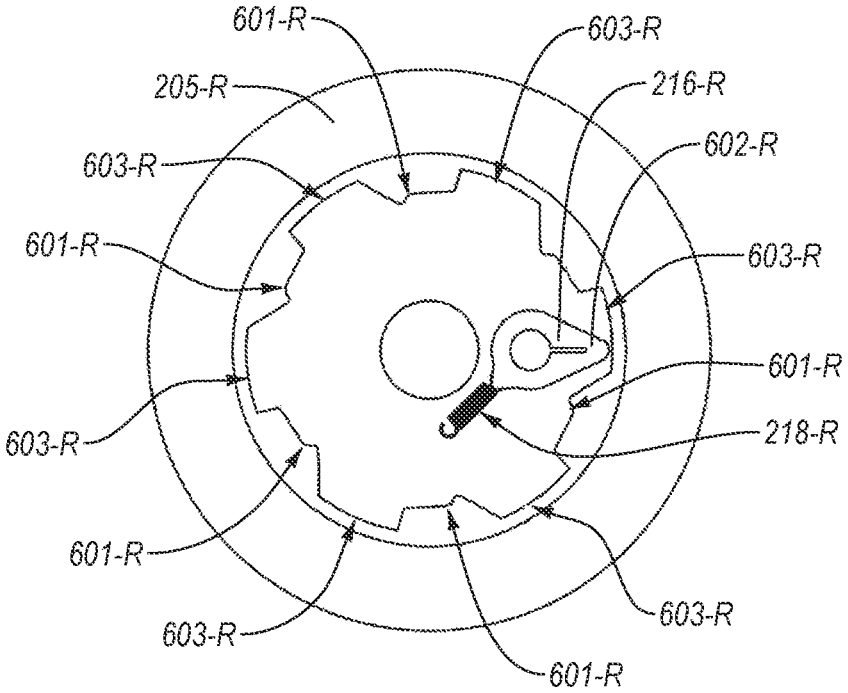
FIG. 7 is an enlarged side elevational view of a portion of the scroll of FIG. 6.

Referring now to FIGS. 6 and 7, the right pawl 216-R and the right pawl spring 218-R are positioned with respect to the right cogwheel 205-R just as they would be if the right end cap were covering the right cogwheel 205-R and the pawl 216-R were pivotably installed on the right pivot pin 215-R and the right pawl spring 218-R were anchored on the right anchoring pin 217-R of the right end cap 214-R. The right cogwheel 205-R is torsionally biased, by the coil torsion spring 202, to rotate in a clockwise direction. Six equiangularly-spaced locking ramps 601-R enable the cogwheel to be locked at 60-degree intervals by pulling on the bottom edge of the sheet 122 and rotating the cogwheel 205-R counterclockwise until the nose 602-R of the pawl 216-R just passes one of the ramps 601-R. It should be remembered that the left cogwheel 205-L has mirror image ramps that are axially aligned with those of cogwheel 205-R. If the cogwheel 205-R is released just after passing a ramp 601-R, the cogwheel 205-R will remain stationary. In order to retract the sheet 122, the bottom edge of the sheet 122 is pulled or tugged, rotating the cogwheel 205-R counterclockwise, until the pawl enters one of the six recesses 603-R. When the sheet 122 is released, the coil torsion spring 202 will rotate the cogwheel 205-R clockwise, without interruption, until the sheet 122 is completely wound about the tube 120 and the rod 124 contacts the slots, channels, or recesses 121 in the left and right legs 218 of the frame 112, thereby preventing any further detensioning of the coil torsion spring 202.

Figure 8:
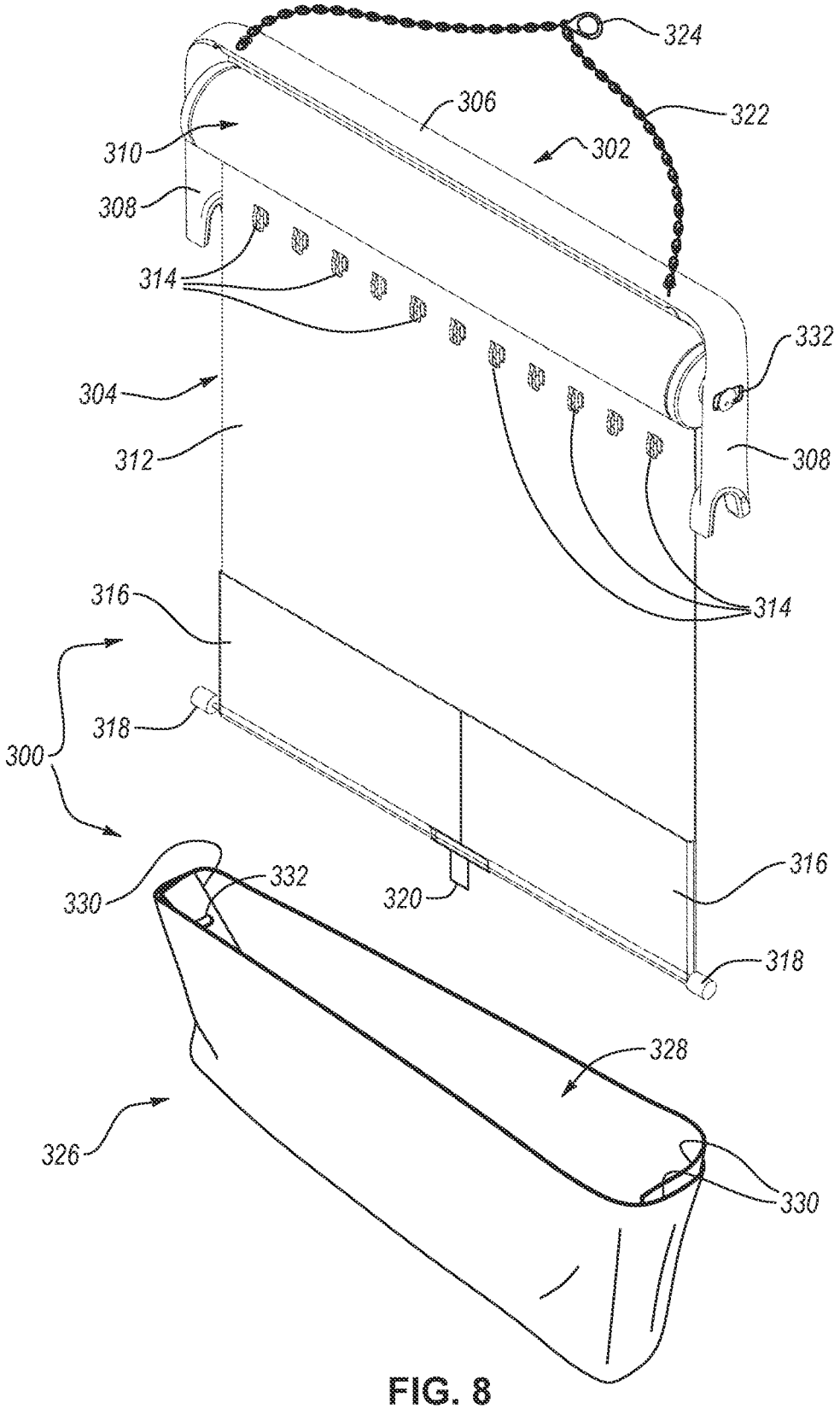
FIG. 8 is a partially exploded perspective view of a retractable jewelry travel scroll according to another example embodiment.
Figure 9:
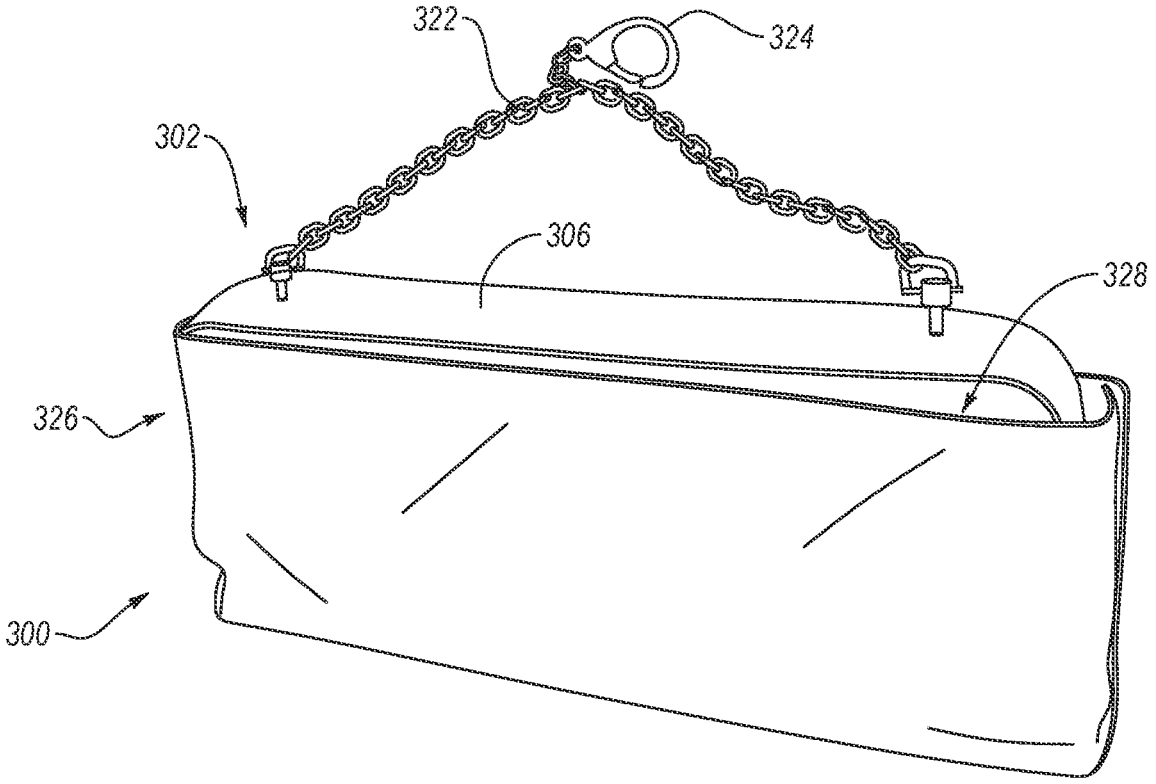
FIG. 9 illustrated the retractable jewelry travel scroll of FIG. 8 with the frame and scroll thereof inserted into a sleeve thereof.

Attention is now directed to FIGS. 8 and 9, which illustrate another retractable jewelry travel scroll 300 according to another example embodiment. In many aspects, the retractable jewelry travel scroll 300 is similar or identical to the retractable jewelry travel scroll 100. Accordingly, the following discussion will focus on the aspects of the retractable jewelry travel scroll 300 that are different from the retractable jewelry travel scroll 100.

As can be seen in FIG. 8, the retractable jewelry travel scroll 300 includes a frame 302 and scroll 304 similar to frame 112 and scroll 114 discussed above. For instance, the frame 302 includes a cross support 306 and legs 308. Likewise, the scroll 304 includes a spring-loaded tube 310, a sheet 312 with jewelry retention members 314 and pockets 316, a rod 318, and a pull 320.

In contrast to the retractable jewelry travel scroll 100, the frame 302 is not configured to be mounted to the interior of a body like the body 102 of FIG. 1. Rather, the frame 302 includes a chain or strap 322 that can be used to carry or hang the retractable jewelry travel scroll 300. In the illustrated embodiment, the chain or strap 322 includes two opposing ends that are connected to the cross support 306 of the frame 302. In other embodiments, the chain or strap 322 may have one or both ends thereof connected to the frame 302.

A hook or clip 324 can be connected to the chain or strap 322. The hook or clip 324 can be used to hang or suspend the jewelry travel scroll 300 from another object (e.g., a clothes rod, door handle, etc.) in either a retracted (rolled-up) configuration or an extended (unrolled) configuration.

As noted, the frame 302 is not mounted within a decorative body as with the frame 102. Rather, the jewelry travel scroll 300 includes a separate sleeve 326. The sleeve 326 can have an opening 328 in an upper end thereof. The sleeve 326 and the opening 328 thereof can be sized and configured to have at least a portion of the frame 302 and scroll 304 therein. For instance, when the sheet 312 is wound around the tube 310, the frame 302 and scroll 304 can be inserted through the opening 328 and into the sleeve 326 as shown in FIG. 9. The sleeve 326 can function to protect the frame 302 and/or scroll 304. Additionally, the sleeve 326 can provide a desirable aesthetic to the jewelry travel scroll 300.

As can be seen in FIG. 8, the interior of the sleeve 326 may include one or more guides or tracks 330 at one or both ends thereof. The guides or tracks 330 may facilitate insertion of the frame 302 into the sleeve 326.

The frame 302 and sleeve 326 may include one or more retention features 332 that are configured to selectively hold the sleeve 326 on the frame 302. By way of example, the outer surfaces of the legs 308 and the interior surface of the sleeve 326 may include one or more corresponding or mating surface features 332 that are configured to engage one another to selectively hold the sleeve 326 on the frame 302. For instance, the outer surfaces of the legs 308 may include a channel, slot, or recess 332 and the interior surface of the sleeve 326 may include corresponding or mating ridges 332. When the frame 302 is inserted into the sleeve 326, the surface features 332 may engage one another with enough friction or force so as to retain the sleeve 326 on the frame 302. However, the friction or force between the surface features 332 may be low enough to allow a user to readily slide the sleeve 326 off of the frame 302.

With the sleeve 326 removed from the frame 302, the sheet 312 may be pulled down relative to the frame 302 to provide access to the jewelry retention members 314, pockets 316, and/or jewelry items stored thereon.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A retractable jewelry scroll comprising:
a frame;
a spring-loaded tube rotatably mounted to the frame;
a sheet having a first end and a second end, the first end being attached to the tube, and the sheet having one or more pockets disposed thereon or therein; and
one or more jewelry retention members attached to the sheet and spaced apart from the one or more pockets.

2. The retractable jewelry scroll of claim 1, wherein the frame comprises a cross support, a first leg extending from a first end of the cross support, and a second leg extending from a second end of the cross support.

3. The retractable jewelry scroll of claim 2, wherein the spring-loaded tub is connected between the first and second legs of the frame.

4. The retractable jewelry scroll of claim 1, further comprising a decorative body mounted on and disposed around at least a portion of the frame.

5. The retractable jewelry scroll of claim 4, further comprising a chain or strap connected to the decorative body.

6. The retractable jewelry scroll of claim 4, wherein the decorative body comprises a pocket therein.

7. The retractable jewelry scroll of claim 1, further comprising a rod attached to the second end of the sheet.

8. The retractable jewelry scroll of claim 7, wherein the rod is configured to engage lower ends of the first and second legs when the sheet is wrapped around the spring-loaded tube.

9. A retractable jewelry scroll comprising:
a decorative body;
a frame mounted to an interior of the decorative body such that the decorative body surrounds a substantial portion of the frame;
a spring-loaded tube rotatably mounted to the frame;
a sheet having a first end and a second end, the first end being attached to the tube, and the sheet having one or more pockets disposed thereon or therein; and
one or more jewelry retention members attached to the sheet and spaced apart from the one or more pockets.

10. The retractable jewelry scroll of claim 9, further comprising a chain or strap connected to the decorative body.

11. The retractable jewelry scroll of claim 9, wherein the decorative body comprises a pocket therein.

12. The retractable jewelry scroll of claim 9, wherein the frame comprises a cross support, a first leg extending from a first end of the cross support, and a second leg extending from a second end of the cross support, the cross support being connected to the decorative body.

13. The retractable jewelry scroll of claim 12, further comprising a rod attached to the second end of the sheet, the rod being configured to engage lower ends of the first and second legs when the sheet is wrapped around the spring-loaded tube.

* * * * *